United States Patent [19]

Walter

[11] Patent Number: 4,519,517

[45] Date of Patent: May 28, 1985

[54] TAMPER INDICATOR FOR CLOSURE

[75] Inventor: John Walter, Evergreen Park, Ill.

[73] Assignee: Continental Can Company, Inc., Stamford, Conn.

[21] Appl. No.: 440,398

[22] Filed: Nov. 9, 1982

[51] Int. Cl.[3] ..... B65D 55/06

[52] U.S. Cl. ..... 215/253; 215/209; 215/237; 220/339; 220/341; 222/541

[58] Field of Search ..... 215/253, 252, 251, 250, 215/237, 235, 236, 263, 209, 239; 220/341, 306, 307, 339, 340, 281; 206/807; 222/541, 543, 153

[56] References Cited

U.S. PATENT DOCUMENTS

| | | | |
|---|---|---|---|
| 4,172,540 | 10/1979 | Erichson | 222/543 |
| 4,209,100 | 6/1980 | Uhlig | 222/153 |
| 4,220,262 | 9/1980 | Uhlig et al. | 222/153 |
| 4,236,653 | 12/1980 | Gach | 222/153 |
| 4,344,545 | 8/1982 | Aschberger et al. | 220/307 |
| 4,361,244 | 11/1982 | Walter | 215/253 |
| 4,371,095 | 2/1983 | Montgomery et al. | 222/153 |
| 4,378,073 | 3/1983 | Luker | 215/237 |

*Primary Examiner*—Allan N. Shoap
*Assistant Examiner*—Bryon Gehman
*Attorney, Agent, or Firm*—Charles E. Brown

[57] ABSTRACT

This relates to a tamper indicating feature for a lever actuated closure. In particular, the lever is provided with a hinge wherein, when the lever is actuated, a free end portion of the lever hinges from its normal planar state with respect to the rest of the lever and, due to the provision of stretchable ribs or webs, the tilted lever free end portion cannot be returned to its initial position planar with the remainder of the lever, and thus sticks up like a sore thumb and indicates tampering.

10 Claims, 5 Drawing Figures

TAMPER INDICATOR FOR CLOSURE

This relates to improvements in tamper indicating means for closures.

This invention particularly relates to a closure for a container wherein the closure element is in the form of a plug which may be forced into and locked within a dispensing mouth which is either part of the container to which the closure is attached or which is a part of the closure per se. The closure to which this invention relates is provided with a lever which is attached to the plug or closure element so as to effect a lifting of the closure element to a released position.

Closures of this type previously had formed in the lever a small ring which was engaged over a rivet carried by the closure element so that when the lever is lifted the ring is torn out of the lever and thereby indicates a tamper. While such an arrangement will provide adequate notice to one who observes an indicator for tampering, the tamper indicating means thus provided is not one which demands attention of a would be user. Accordingly, it is deficient only in that aspect.

In accordance with this invention, it is proposed to form the lever with a hinge construction whereby, when the free end of the lever is lifted to initiate closure opening, the free end portion of the lever will hinge relative to the remainder of the lever and will not assume its original one portion planar state, thereby resulting in a previously opened closure having the free end portion of the lever thereof stricking up like a sore thumb to indicate tampering.

Most particularly, the lever is provided with a hinged arrangement which is defined by two transverse reinforcing ribs having extending therebetween at least one stretchable rib which prevents the return of the free end portion of the lever to its original position once the stretchable rib is stretched during opening of the closure.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
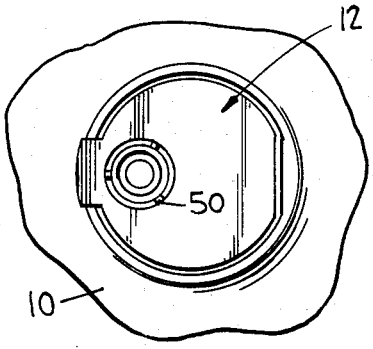
FIG. 1 is a plan view of a closure incorporating this invention, and shows the same attached to a container.

Referring now to the drawings in detail, it will be seen that there is illustrated in FIG. 1 a fragmentary top portion of a container 10 which is closed by way of a closure 12 in accordance with this invention.

In the illustrated form of the invention, the container 10 has a neck portion 14 which terminates in a radially inwardly directed and downwardly facing shoulder 16. The container neck extends above the shoulder 16 in the form of a generally hook-shaped portion 18.

The closure 12 includes a collar 20 which is telescoped over the container neck and has an internal upwardly facing shoulder 22 which is engaged beneath the terminal part of the hook-shaped portion 18 to lock the collar 20 in place on the container 10 and thus retain the closure 12 assembled with the container 10 at all times.

Figure 2:
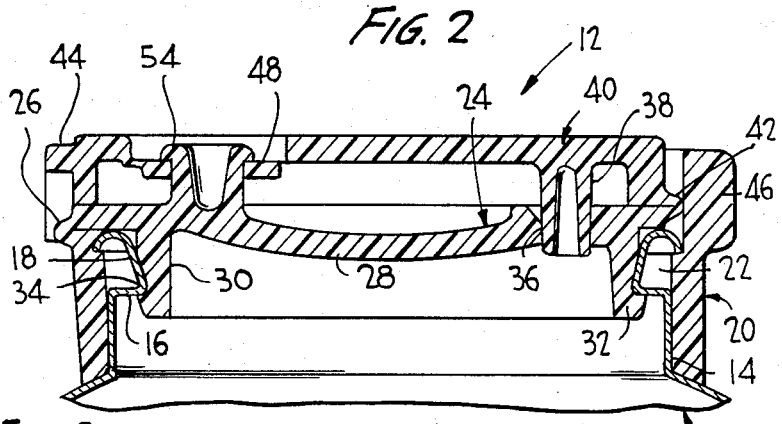
FIG. 2 is an enlarged fragmentary vertical sectional view taken generally along the line 2—2 of FIG. 1, and shows the specifics of the closure.

A plug or closure element 24 is hingedly connected to the collar along a hinge section 26 for movement between a container closing position and an open position while being retained as part of the container. The plug or closure element 24 includes an end panel 28 having a depending tubular portion 30 which is provided at its lower end with an enlargement 32 which defines a shoulder 34 that locks behind the shoulder 16 when the closure element 24 is forcibly engaged in the mouth of the container 10 as shown in FIG. 2.

When the container 10 contains a product under pressure, the end panel 28 may be provided with a vent opening 36 which is normally closed by a plug 38 which depends from an underside of a lever 40 which overlies the closure element 24. The lever 40 is connected to the closure element 24 by a hinge 42 which is parallel to and remote from the hinge 26.

It is to be understood that when the product within the container 10 is to be dispensed, the lever 40 will be lifted at a lift end 44 thereof remote from the hinge 42, with the result that the plug 38 will be pulled from its position sealing the vent opening so as to vent the interior of the container to the atmosphere.

Continued upward pivoting of the lever 40 in a clockwise direction will result in the lever pivoting against an upstanding pivot element 46 carried by the collar 20 adjacent the hinge 40 and the lifting and pulling of the plug or closure element 24 out of the container.

In the past, the closure 12 has been provided with a tamper indicating device in the form of a ring 48 which is formed as part of the lever 40, but which is attached to the lever by small rupturable tabs 50 positioned generally at the 12:00, 4:00 and 8:00 o'clock positions.

The closure element 24 is provided with a hollow rivet 52 which is positioned to pass through the ring member 48, after which the rivet 52 is upset as at 54 to lock the ring member 48 thereto.

When the lever 40 is initially lifted, the tabs 50 will rupture and the ring member 48 will remain on the rivet 52 to indicate tampering.

Figure 3:
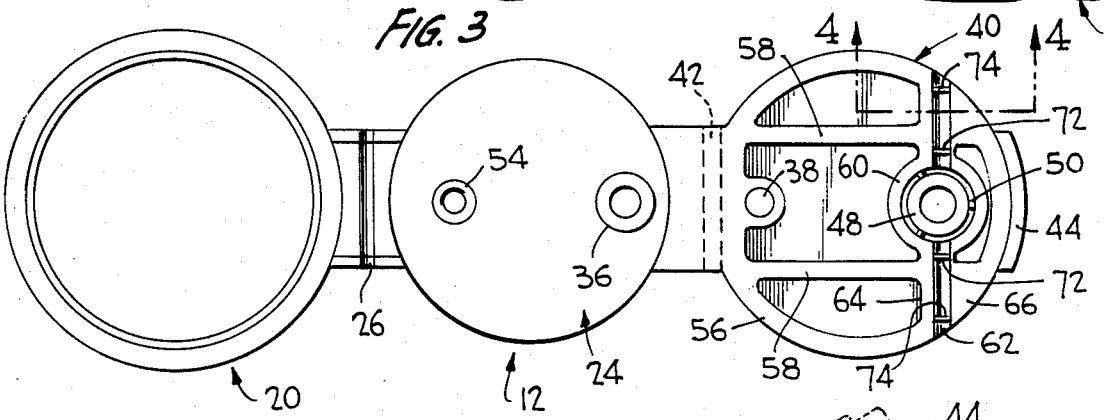
FIG. 3 is a plan view of the closure in its as-molded state, and shows specifically the details of the hinge means formed in the lever.

The closure 12, thus described, is improved in accordance with this invention. With reference to FIG. 3 wherein the underside of the lever 40 is illustrated, it will be seen that the lever is provided with a peripheral reinforcement 56. It is also provided with longitudinal reinforcing ribs 58. The area surrounding the ring 48 is also provided with an annular reinforcing rib 60.

Figure 4:
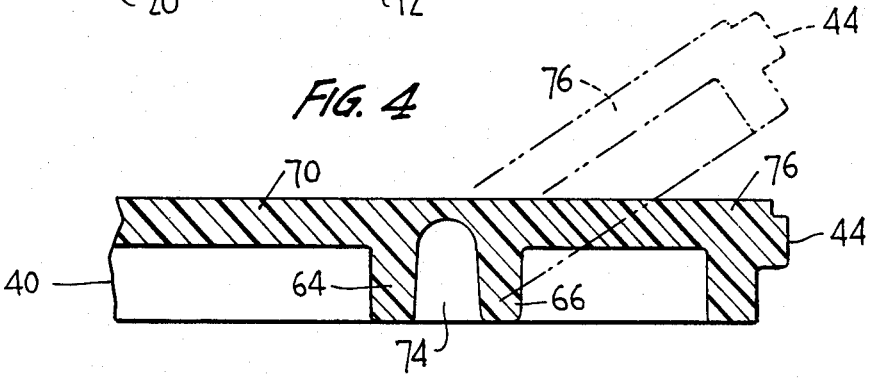
FIG. 4 is an inverted fragmentary longitudinal sectional view through the lever taken generally along the line 4—4 of FIG. 3, and shows specifically the details of the hinge construction and also the displaced position of the lever free end after hinging takes place.

In accordance with the invention, the lever is provided in transverse alignment with the ring member 48 with a hinge construction 62. The hinge construction is disposed on opposite sides of the ring member 48 and includes a pair of spaced transverse ribs 64, 66 which define a hinge line. The ribs 64, 66 are best shown in FIG. 4 as is a thinning 68 of the wall 70 of the lever 40. Immediately adjacent the reinforcement 60, the hinge is spanned by a stretchable web or rib 72 which extends between the reinforcing ribs 64, 66. A further set of stretchable ribs or webs 74 span between the ribs 64, 66 adjacent the outer ends of the ribs.

It is to be understood that when the grip portion 44 of the lever 40 is engaged with one's finger and an upward force is exerted on the free end of the lever 40, the lever will hinge along the transverse hinge line 62 between the ribs 64, 66 as shown in dotted lines in FIG. 4. This end portion 76 of the lever 40 will assume an angular relationship to the remainder of the lever 40 and will be prevented from returning to its original one-piece planar status due to the stretching of the ribs 72, 74.

It is to be understood that normally the pivoting or hinging of the lever free end portion 76 will occur before the ring member 48 is torn from the lever 40. However, the hinging of the lever end portion 76 will normally result in the breaking of the rib or tab 50 located at the 12:00 o'clock position.

If no further attempt is made to open the closure 12, the free end portion 76 of the lever will remain in its upwardly tilted position and will indicate very plainly that an opening operation has been initiated even though not completed.

Figure 5:
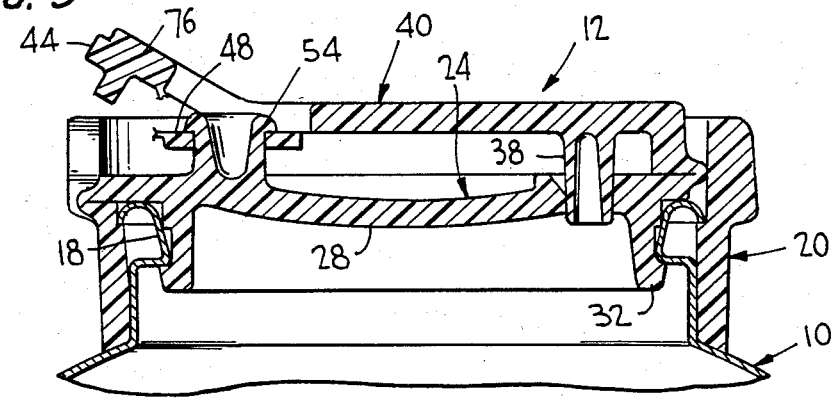
FIG. 5 is a sectional view similar to FIG. 2, and shows the closure after it has been initially opened with the closure element or plug back in place and with the lever pushed back as close as possible to its original position.

On the other hand, if the opening operation is completed but completed only to the extent that the tamper indicating ring member 48 has been torn from the lever and the lever is pushed back as nearly as possible to its original position, as shown in FIG. 5, even if the tampering is not observed by observing the removal of the ring member 48, the upstanding position of the lever end portion 76 will continue to give a clear indication of tampering.

Although the non-returnable hinging of the end portion of the lever has been illustrated in conjunction with a specific type of closure which already has a tamper indicating feature, it is to be understood that the non-returnable hinge feature which is the subject of this invention may be utilized in other and quite different lever actuated closures.

While the illustrated closure 12 is shown as being formed of plastic and at the present this is the most feasible material, it is to be understood that the invention is not restricted to the use of plastic materials in the formation of the lever.

I claim:

1. A closure of the type including a closure member having attached thereto a lever for applying a removing force to said closure member, said lever being normally generally planar; the improvement residing in providing said lever with deformable hinge means for causing a permanent displacement of a free end portion of said lever, said deformable hinge means extending transversely across said lever relative to the direction of force application by said lever whereby after said lever has been folded from its closed position and returned thereto said free end portion of said lever will unnaturally project out of said generally planar state to indicate tampering.

2. A closure of the type including a closure member having attached thereto a lever for applying a removing force to said closure member, said lever being normally generally planar; the improvement residing in providing said lever with deformable hinge means extending transversely across said lever relative to the direction of force application by said lever whereby after said lever has been folded a free end portion of said lever will unnaturally project out of said generally planar state to indicate tampering, said hinge means including a transverse hinge line and at least one stretchable web extending longitudinally of said lever and transversely of said hinge line for resisting return of said lever to said generally planar state.

3. A closure according to claim 2 wherein said lever is initially held in said generally planar state by rupturable retaining means.

4. A closure according to claim 2 wherein said lever is initially held in said generally planar state by rupturable retaining means including a tear-out segment of said lever.

5. A closure according to claim 2 wherein said lever is initially held in said generally planar state by rupturable retaining means including a tear-out segment of said lever, said hinge line being on transversely opposite sides of and interrupted by said tear-out segment.

6. A closure according to claim 5 wherein said tear-out segment is annular and has a retaining pin extending therethrough, said retaining pin intersecting the general line of said hinge line.

7. A closure according to claim 6 wherein there is one of said stretchable webs on each side of said tear-out segment.

8. A closure according to claim 5 wherein there is one of said stretchable webs on each side of said tear-out segment.

9. A closure of the type including a closure member having attached thereto a lever for applying a removing force to said closure member, said lever being normally generally planar; the improvement residing in providing said lever with deformable hinge means causing a permanent displacement of a free end portion of said lever, said deformable hinge means extending transversely across said lever relative to the direction of force application by said lever whereby after said lever has been folded said free end portion of said lever will unnaturally project out of said generally planar state to indicate tampering, said lever being initially held in said generally planar state by rupturable retaining means including a tear-out segment of said lever, said hinge line being on transversely opposite sides of and interrupted by said tear-out segment.

10. A closure according to claim 9 wherein said tear-out segment is annular and has a retaining pin extending therethrough, said retaining pin intersecting the general line of said hinge line.

* * * * *